US006737937B2

(12) United States Patent
Harel

(10) Patent No.: US 6,737,937 B2
(45) Date of Patent: May 18, 2004

(54) MICROWAVE FILTER AND A TELECOMMUNICATION ANTENNA INCLUDING IT

(75) Inventor: Jean-Pierre Harel, Lannion (FR)

(73) Assignee: Alcatel, Paris (FR)

( * ) Notice: Subject to any disclaimer, the term of this patent is extended or adjusted under 35 U.S.C. 154(b) by 41 days.

(21) Appl. No.: 10/087,835

(22) Filed: Mar. 5, 2002

(65) Prior Publication Data

US 2002/0140521 A1 Oct. 3, 2002

(30) Foreign Application Priority Data

Mar. 29, 2001 (FR) ..... 01 04255

(51) Int. Cl.[7] ..... H01P 5/12; H01P 7/10; H01P 7/00

(52) U.S. Cl. ..... 333/134; 333/219.1; 333/235

(58) Field of Search ..... 333/134, 219.1, 333/235

(56) References Cited

U.S. PATENT DOCUMENTS 4,583,064 A * 4/1986 Makimoto et al. ..... 333/219
4,694,260 A * 9/1987 Argintaru et al. ..... 331/9
5,432,489 A * 7/1995 Yrjola ..... 333/202
6,201,801 B1 3/2001 Dent
6,255,917 B1 * 7/2001 Scott ..... 333/202
6,359,529 B1 * 3/2002 Tsunoda et al. ..... 333/101

OTHER PUBLICATIONS

Patent Abstracts of Japan, vol. 016, No. 215 (E–1204), May 20, 1992, and JP 04 035505 A (Sumitomo Electric Ind Ltd), Feb. 6, 1992.

Patent Abstracts of Japan, vol. 013, No. 503(E–844), Nov. 13, 1989 and JP 01 200814 A (Nippon Telegr & Teleph Corp), Aug. 14, 1989.

Cros D et al: "Whispering Gallery Dielectric Resonator Filters" 1996 IEEE MTT–S International Microwave Symposium Digest. San Francisco, Jun. 17–21, 1996, IEEE MTT–S International Microwave Symposium Digest, New York, IEEE, US, vol.. 2 Jun. 17, 1996 pp. 603–606, XP000731941.

* cited by examiner

*Primary Examiner*—Patricia Nguyen
(74) *Attorney, Agent, or Firm*—Sughrue Mion, PLLC

(57) ABSTRACT

A microwave filter includes at least two dielectric resonators, a transmission microstrip, and at least one lateral microstrip constituting a branch connected to the transmission microstrip. Each lateral microstrip is coupled to at least one dielectric resonator to resonate therewith. The filter is compact and can therefore be incorporated into the housing of a microwave antenna, in particular a multiband antenna for mobile telephone networks.

11 Claims, 2 Drawing Sheets

FIG.1
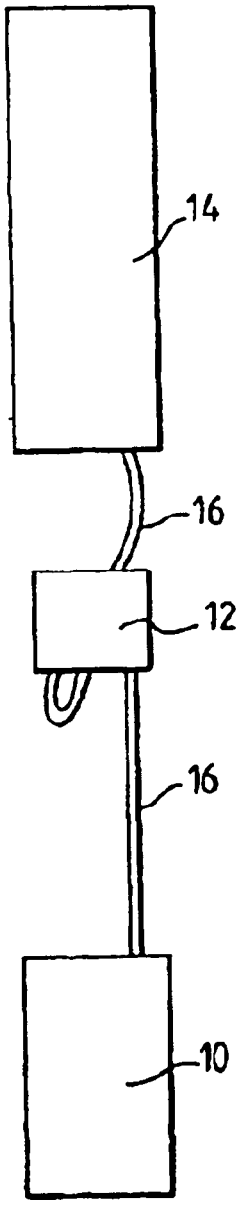
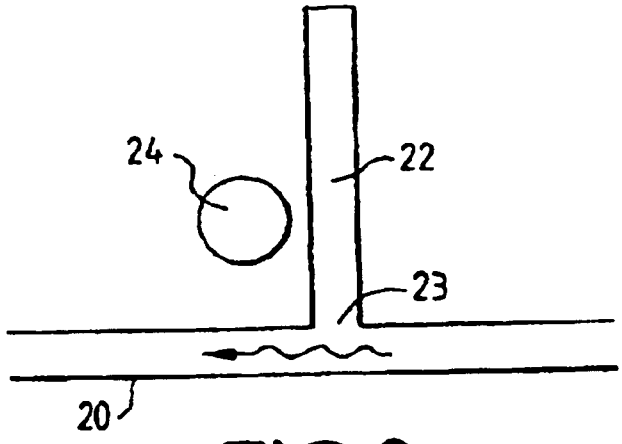
FIG.2
(PRIOR ART)

MICROWAVE FILTER AND A TELECOMMUNICATION ANTENNA INCLUDING IT

CROSS-REFERENCE TO RELATED APPLICATIONS

This application is based on French Patent Application No. 01 04 255 filed Mar. 29, 2001, the disclosure of which is hereby incorporated by reference thereto in its entirety, and the priority of which is hereby claimed under 35 U.S.C. §119.

BACKGROUND OF THE INVENTION

1. Field of the Invention

The present invention relates to a filter and to an antenna including the filter, which antenna can in particular be used in a mobile telephone network.

2. Description of the Prior Art

A telecommunication antenna sends and receives radio waves at frequencies specific to a telecommunication system using the antenna. Thus an antenna for the Global System for Mobile communications (GSM) sends and receives waves whose frequencies are in the 870–960 MHz band.

FIG. 1 shows an installation which includes a GSM base station 10 and a GSM antenna 14. A base station is usually at ground level, for ease of maintenance, whereas an antenna is usually high up—on a pylon, water tower, etc.—to maximize its send and receive coverage area. For this reason the station 10 is connected to the antenna 14 by cables 16 transmitting radio waves between them.

Various forms of electromagnetic interference, due to waves sent by another antenna, for example, degrade the waves transmitted in this way. Also, the waves produced by the station 10 may include unwanted frequencies outside the GSM frequency band. A filter 12 is therefore placed between the base station 10 and the antenna 14. The filter 12 processes the waves transmitted by the cables 16 to attenuate those whose frequency is outside the band used by the antenna 14. The filter 12 is an air filter, for example, formed by a hollow enclosure with metal walls whose dimensions are such that waves at particular frequencies are attenuated by resonance as they propagate in the enclosure.

Locating filters outside the antennas has many drawbacks. The cables used in these installations are costly. The quantity of cable used is increased by locating the filters outside the antennas. Also, manual connection of the cables to the filters leads to additional costs and the risk of damage to the cables and the filters. Using cables between the filters and the antennas degrades the waves transmitted by the cables, because of transmission losses or external interference due in particular to signals radiated by other antennas. This is undesirable, especially for the waves sent to the antenna, because they are not filtered afterward.

U.S. Pat. No. 6,201,801 describes a single-band antenna in which a single send/receive filter is disposed inside the chassis or housing containing the radiating elements of the antenna.

Multiband antennas including radiating elements used for respective different telecommunication systems are known in the art. A multiband antenna of this kind requires filters, but producing filters incorporated into the same chassis or housing as the antenna is particularly difficult, because of the size of the filters. For example, in a multiband antenna including GSM radiating elements using the 870–960 MHz band and radiating elements for the Digital Cellular System (DCS) using the 1710–1880 MHz band, it is necessary to provide a GSM filter and a DCS filter respectively connected to the GSM radiating elements and to the DCS radiating elements.

The object of the invention is to propose a microwave filter that can easily be incorporated into a multiband antenna.

SUMMARY OF THE INVENTION

The invention provides a microwave filter including a transmission microstrip, at least one lateral microstrip connected to the transmission microstrip, and at least two dielectric resonators, and wherein said at least one lateral microstrip is coupled to said at least two dielectric resonators so that it can resonate with said at least two dielectric resonators.

The above filter enables filters to be incorporated into the chassis or housing of an antenna because the collaboration of at least two resonators with the same microstrip provides a filter which, for the same performance, is more compact than a combination of independent filters each including a dielectric resonator collaborating with a single lateral microstrip.

In a preferred embodiment, the lateral microstrips form a series of U-shapes, two successive U-shapes having a common branch.

In a particular embodiment, the center of each dielectric resonator is equidistant from two branches of a U-shape.

In a preferred embodiment, each dielectric resonator has a relative permittivity of not less than 10.

The filter advantageously further includes adjustment elements adapted to be moved arbitrarily relative to the dielectric resonators to modify respective resonant frequencies of the dielectric resonators.

In a preferred embodiment, each lateral microstrip has a length substantially equal to $3\lambda_m/4$ where $\lambda_m$ represents a wavelength to be attenuated.

The invention also provides a microwave antenna including radiating elements and at least one filter as defined above in a common chassis or housing.

One embodiment of the antenna includes radio frequency protection for the filter.

Other features and advantages of the invention will become apparent from the description of embodiments of the invention given by way of non-limiting example and with reference to the accompanying drawings.

BRIEF DESCRIPTION OF THE DRAWINGS

FIG. 1 already described, represents an antenna installation.

FIG. 2 shows a prior art filter with microstrip and dielectric resonators.

DETAILED DESCRIPTION OF THE PREFERRED EMBODIMENT

Figure 3:
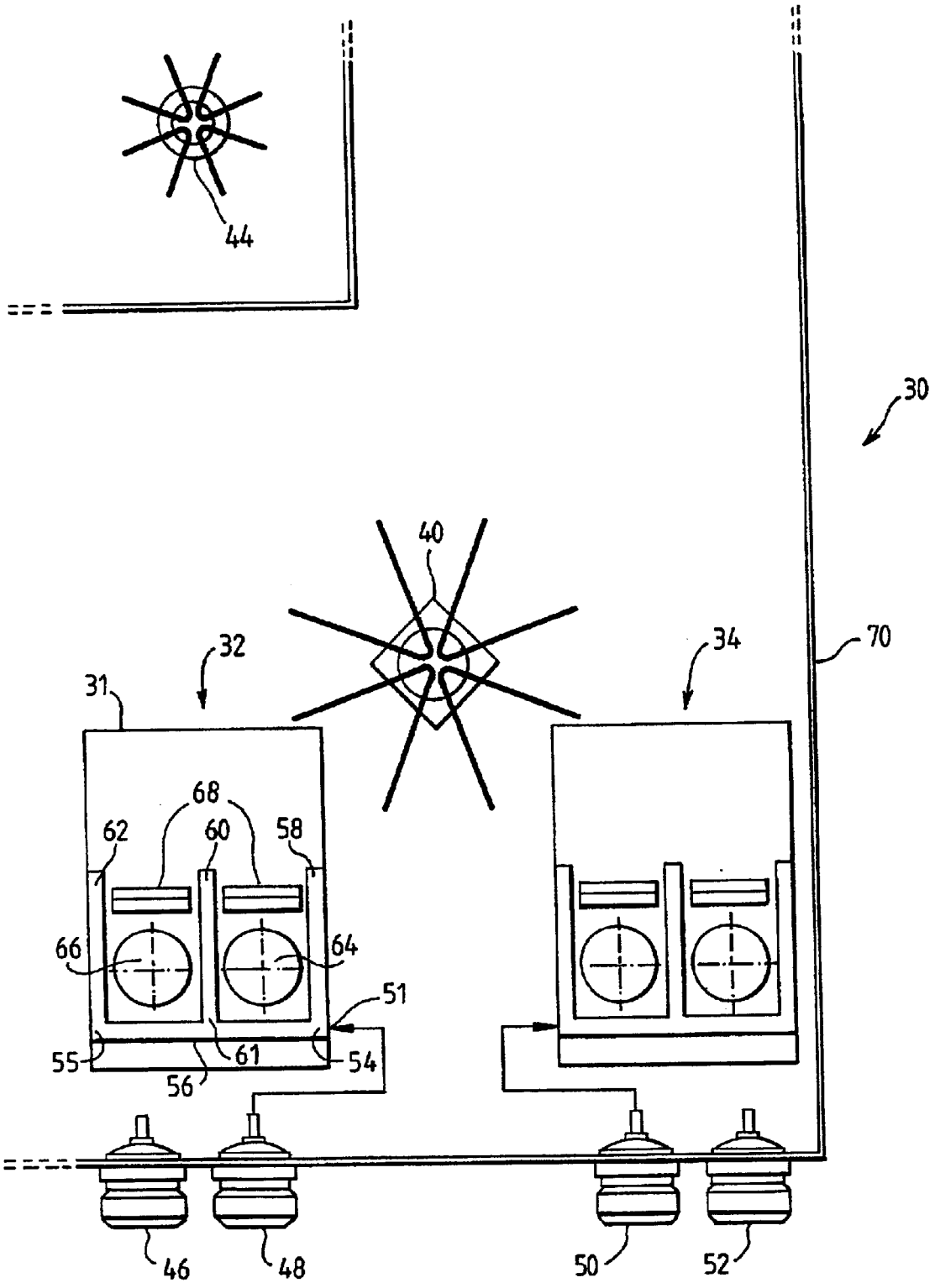
FIG. 3 is a partial view of the interior of one embodiment of an antenna incorporating two filters according to the invention.

FIG. 2 shows a prior art filter with microstrip and dielectric resonator. The filter includes a transmission microstrip 20 constituting a transmission line for radio waves. A lateral microstrip 22 forms an orthogonal branch having a free end and an end connected to the microstrip 20 at a branching point 23. The lateral microstrip 22 has a length of $3\lambda_{22}/4$, where $\lambda_{22}$ represents a propagation wavelength of certain waves transmitted by the microstrip 20. The lateral microstrip 22 is disposed so that it can be coupled to a dielectric resonator 24.

To guide radio waves, the microstrips 20 and 22 consist of a conductive material, such as a metal, deposited on an insulative material. The lateral microstrip 22 attenuates waves at a wavelength of $\lambda_{22}$ transmitted by the transmission microstrip 20 by dissipating their energy through a phenomenon of resonance at a frequency corresponding to said wavelength $\lambda_{22}$.

Moreover, the center of the dielectric resonator 24 is placed at a distance of $\lambda_{22/24}$ from the connection point 23 of the microstrip 20 and the microstrip 22. The resonator 24 attenuates waves at a wavelength of $\lambda_{22/24}$ transmitted by the transmission microstrip 20 by resonating with the lateral microstrip 22 at a frequency corresponding to a wavelength of $\lambda_{22/24}$.

The wavelength $\lambda_{22/24}$ is close to $\lambda_{22}$. For example, for wavelengths of the order of one millimeter, the differences $(\lambda_{22}-\lambda_{22/24})$ are of the order of a few hundredths of a millimeter. This kind of filter therefore attenuates a narrow range of wavelengths between the wavelengths $\lambda_{22}$ and $\lambda_{22/24}$. To attenuate a wider range of wavelengths with this type of filter, a plurality of such filters must be used. The size of the plurality of filters would then be too great compared to the available space within the chassis or housing of an antenna.

The invention provides a microstrip antenna including a transmission microstrip, at least one lateral microstrip constituting a branch, and at least two dielectric resonators coupled to the same lateral microstrip. It is then found that the range of wavelengths filtered by this single filter is expanded, at the cost of an increase in overall size that is smaller than if two or more than two independent filters were used each consisting of a dielectric resonator coupled to a single branch.

FIG. 3 is a partial view of the interior of a multiband GSM/DCS antenna 30 incorporating two filters 32, 34 according to the invention. The antenna 30 includes GSM radiating elements 40 for sending and receiving radio waves in the GSM band and DCS radiating elements 44 for sending and receiving radio waves in the DCS frequency band. FIG. 3 shows only one GSM radiating element 40 and one DCS radiating element 44. The GSM radiating elements 40 and the DCS radiating elements 44 are connected to base stations (not shown) external to the antenna 30. The GSM base station is connected to inputs 48 and 50 of the antenna 30 and the DCS base station is connected to inputs 46 and 52.

The use of two feed inputs for the same radiating elements device is due to the nature of the radiating elements used. Each radiating element 40 or 44, the operation of which is described in U.S. Pat. No. 6,025,798, for example, is equivalent to two independent dipoles at 90° to each other. Because of this 90° offset, the dipoles transmit signals correctly, regardless of the position of a sending or receiving antenna relative to the radiating elements.

The input 48 is connected to a filter 32 according to the invention to filter the waves transmitted between the GSM base station and the radiating elements 40; the input 50 is connected to a filter 34 according to the invention. The filters 32 and 34 are inside the chassis or housing 70 of the antenna 30.

Only the filter 32 is described below, the filters 32 and 34 being identical. The filter 32 has an input 51 connected to the GSM input 48 of the antenna. The input 51 is a first end 54 of a transmission microstrip 56. The other end 55 of the transmission microstrip 56 is connected by means that are not shown to one of the GSM radiating elements 40.

The transmission microstrip 56 is made of a conductive material, for example a metal, disposed on an insulative material. It is connected to three lateral microstrips 58, 60 and 62 constituting branches disposed transversely relative to the microstrip 56 and having the same width and the same nature thereas. To be more precise, a first end of the lateral microstrip 58 is connected to the end 51 of the transmission microstrip 56, a first end of the lateral microstrip 60 is connected to a central portion 61 of the transmission microstrip 56, and a first end of the lateral microstrip 62 is connected to the other end 55 of the microstrip 56. In this embodiment, the second ends of the microstrips 58, 60, 62 are not connected to anything.

The resonators 64 and 66 are of standard design. They are ceramic cylinders made of alloys containing magnesium, calcium, titanium, barium, zinc, zirconium or tin. These ceramic materials have high dielectric constants $\epsilon_r$, i.e. dielectric constants at least equal to 10.

The microstrips 58, 60, 62 and the dielectric resonators 64 and 66 have characteristics such that, and are disposed so that, some frequencies are attenuated by dissipation of energy due to resonance of the lateral micro strips 58, 60, 62 and the resonators 64 and 66 coupled to the lateral microstrips 58, 60, 62. In particular, the lateral microstrip 60 is coupled both to the resonator 64 and to the resonator 68.

In this embodiment, the microstrips 58, 60 and 62 have a length substantially equal to $3\lambda_m/4$ where $\lambda_m$ represents a wavelength to be attenuated.

The microstrip 58 attenuates waves with the wavelength $\lambda_m$ by resonating at the frequency corresponding to the wavelength $\lambda_m$.

The resonator 64 is equidistant from the microstrips 58 and 60 and its center is at a distance of $\lambda_m/4$ from the end 51 of the microstrip 56, i.e. from the junction between the transmission microstrip 56 and the lateral microstrip 58. The resonator 64 therefore resonates at a wavelength of $\lambda_{m/64}$ with the microstrip 58. This resonance dissipates the energy of the waves at wavelength $\lambda_{m/64}$, so attenuating them.

The lateral microstrip 60 also attenuates waves by resonance. However, it is found experimentally that this resonance occurs at a wavelength $\lambda_{60}$ offset from the wavelength $\lambda_m$. Furthermore, the resonator 64 is also coupled to the lateral microstrip 60. The resonator 64 then dissipates energy associated with a wavelength $\lambda_{60/64}$ by resonance, attenuating waves transmitted with that wavelength $\lambda_{60/64}$.

The resonator 66 is equidistant from the lateral microstrips 60 and 62. Its center is at a distance of $\lambda_m/4$ from the branching point 61, i.e. from the junction between the transmission microstrip 56 and the lateral microstrip 60. Its characteristics are chosen so that the resonator 66 resonates with the microstrip 60 at a frequency corresponding to a wavelength $\lambda_{60/66}$. The resonator 66 then dissipates energy associated with a wavelength of $\lambda_{60/66}$ by resonance, thereby attenuating waves transmitted with that wavelength $\lambda_{60/66}$.

The waves transmitted by the transmission microstrip 56 are then filtered by the lateral microstrip 62. The microstrip 62 attenuates waves transmitted at a wavelength $\lambda_{62}$ by dissipating energy by resonance at that wavelength.

Furthermore, the center of the resonator 66 is at a distance of $\lambda_m/4$ from the branching point 55 of the lateral microstrip 62. The resonator 66 resonates with the microstrip 62 at a frequency corresponding to another wavelength $\lambda_{62/64}$. The resonator 66 then dissipates energy associated with the wavelength $\lambda_{62/64}$ by resonance, thereby attenuating waves transmitted at that wavelength $\lambda_{62/64}$.

Thus waves transmitted by the transmission microstrip 56 are attenuated at a series of wavelengths covering a wide band.

It is found experimentally that a frequency band with a relative width from 1% to 5% of the center frequency is attenuated, the relative width of a band being defined as:

$$(\lambda_{max}-\lambda_{min})/((\lambda_{max}+\lambda_{min})/2)$$

where $\lambda_{max}$ represents the greatest wavelength attenuated and $\lambda_{min}$ the smallest wavelength attenuated, referred to an attenuation of 3 dB.

The filter is therefore equivalent to a plurality of prior art filters, i.e. filters associating a resonator with a single branch microstrip. However, thanks to a smaller number of dielectric resonators and branches, for equal performance the size of the filter is compatible with the restricted space available inside the chassis or housing of the antennas.

In a variant that is not shown, the lateral microstrips 58, 60 and 62 have a length of $3\lambda_m/4$ and their second ends are grounded. In this case, the centers of the resonators 64 and 66 are disposed at a distance of $\lambda_m/2$ from the respective branching points between the transmission microstrip 56 and the lateral microstrips 58, 60, 62 so that they can resonate with the lateral microstrips 58, 60, 62.

To tune it to different wavelengths, the filter 32 includes two adjustment elements 68 near the resonators 64 and 66, respectively, which modify the wavelength attenuated by resonance. To be more precise, the elements 68 are grounded conductors which influence the capacitive effect of the resonator. The resonator can be modeled as a circuit including a resistor, an inductor and a capacitor in parallel with the inductor. Moving a conductive element 68 toward a resonator increases its capacitive effect and consequently modifies the resonant frequency.

In this embodiment a metal protective cap 31 covering all of the components of the filter 32 protects the filter from radio waves, and in particular from waves emitted by the GSM radiating elements 40 and the DCS radiating elements 44 of the antenna.

Because the filter 32 is near the GSM radiating elements 40 and the DCS radiating elements 44, the degradation and the losses of the waves transmitted by the connections between these radiating elements and the filter are less than when the filter is outside the chassis or cap of the antenna.

Using resonators made of materials having high dielectric constants improves rejection, which can be better than −20 dB and is therefore significantly increased compared to that of microstrip filters with no dielectric resonator, which achieve a rejection of the order of −5 dB.

In terms of the quality factor Q, a microstrip filter coupled to dielectric resonators achieves values of 500 or 1000, whereas filters with no dielectric resonator achieve values of 50 to 200.

These high attenuations are particularly useful in telecommunication systems operating in closely spaced frequency bands. In this case, the radiating elements using a first frequency band degrade transmission in a second band close to the first band, and vice versa. This situation arises, for example, on simultaneous DCS transmission using the 1710–1880 MHz band and UMTS (Universal Mobile Telecommunication System) transmission using the 1910–2100 MHz band.

The present invention lends itself to many variants. Thus in one variant, not shown, the filters 32 and 34 are placed on the back of the antenna, i.e. behind a metal plate supporting the radiating elements on its front face.

There is claimed:

1. A microwave filter including a transmission microstrip, at least one lateral microstrip connected to said transmission microstrip, at least two dielectric resonators, and means coupled to said at least two dielectric resonators for resonating with said at least two dielectric resonators and for attenuating an undesired frequency of signals transmitted by said transmission microstrip, said means comprising at least one lateral microstrip extending, over its entire length, only transversely to said transmission microstrip.

2. A microwave filter including a transmission microstrip, at least one lateral microstrip connected to said transmission microstrip, and at least two dielectric resonators, and wherein said at least one lateral microstrip is coupled to said at least two dielectric resonators so that it can resonate with said at least two dielectric resonators, and wherein plural lateral microstrips form a series of U-shapes, two successive U-shapes having a common branch.

3. The filter claimed in claim 2 wherein the center of each dielectric resonator is equidistant from two branches of a U-shape.

4. The filter claimed in claim 1 wherein each dielectric resonator has a relative permittivity of not less than 10.

5. The filter claimed in claim 1 further including adjustment elements adapted to be moved arbitrarily relative to said dielectric resonators to modify respective resonant frequencies of said dielectric resonators.

6. The filter claimed in claim 1 wherein said lateral microstrip has a length substantially equal to $3\lambda_m/4$ where $\lambda_m$ represents a wavelength to be attenuated.

7. A microwave filter including a transmission microstrip, at least one lateral microstrip connected to said transmission microstrip, and at least two dielectric resonators, and wherein said at least one lateral microstrip is coupled to said at least two dielectric resonators so that it can resonate with said at least two dielectric resonators, wherein said filter includes at least three lateral microstrips connected to said transmission microstrip, and at least two dielectric resonators respectively placed between a first and a second lateral microstrip and between the second lateral microstrip and a third lateral microstrip.

8. A microwave antenna including radiating elements and at least one microwave filter in a common chassis or housing, said filter including a transmission microstrip, at least one lateral microstrip connected to said transmission microstrip, and at least two dielectric resonators, and wherein said at least one lateral microstrip is coupled to said at least two dielectric resonators so that it can resonate with said at least two dielectric resonators.

9. The antenna claimed in claim 8 including radio frequency protection for said filter.

10. The antenna claimed in claim 8 including radiating elements operating in different frequency bands.

11. The filter claimed in claim 1, wherein said lateral microstrip has a free end which is not connected to anything.

* * * * *